United States Patent [19]

Daum

[11] Patent Number: 4,639,057

[45] Date of Patent: Jan. 27, 1987

[54] ELECTRICAL CONNECTOR FOR PRINTED CIRCUITS

[75] Inventor: Ronald E. Daum, Warren, Ohio

[73] Assignee: General Motors Corporation, Detroit, Mich.

[21] Appl. No.: 708,788

[22] Filed: Mar. 6, 1985

[51] Int. Cl.[4] ..... H01R 9/07; H01R 9/09

[52] U.S. Cl. ..... 339/17 F; 339/176 MP

[58] Field of Search ..... 339/17 F, 97 C, 176 MF, 339/176 MP

[56] References Cited

U.S. PATENT DOCUMENTS

| | | | |
|---|---|---|---|
| 2,904,768 | 9/1959 | Rasmussen | 339/17 LM |
| 3,340,440 | 9/1967 | Minter | 339/176 MP |
| 3,795,885 | 3/1974 | Desso et al. | 339/17 F |
| 4,029,374 | 6/1977 | Nestor et al. | 339/17 F |
| 4,168,874 | 9/1979 | Weidler et al. | 339/128 |
| 4,439,000 | 3/1984 | Kaufman et al. | 339/176 MP |

FOREIGN PATENT DOCUMENTS

| | | | |
|---|---|---|---|
| 720950 | 11/1965 | Canada | 339/176 MP |
| 2246539 | 4/1973 | Fed. Rep. of Germany | 339/176 MF |
| 2547174 | 5/1977 | Fed. Rep. of Germany | 339/176 MP |
| 948391 | 2/1964 | United Kingdom | 339/176 MF |
| 1001569 | 8/1965 | United Kingdom | 339/176 MP |

*Primary Examiner*—Gil Weidenfeld
*Assistant Examiner*—Gary F. Paumen
*Attorney, Agent, or Firm*—F. J. Fodale

[57] ABSTRACT

An electrical connector for printed circuits comprises a dielectric connector body and a plurality of sinuous contact strips which have clip portions which are disposed in a socket portion of the connector body for detachable connection to an end tab of a printed circuit board inserted into the socket portion and elongated portions which are associated with a trailing attachment portion of the connector body for permanent connection to a flexible printed circuit by crimped spliced ferrules.

10 Claims, 4 Drawing Figures

ELECTRICAL CONNECTOR FOR PRINTED CIRCUITS

This invention relates generally to an electrical connector and, more particularly, to an electrical connector for connecting printed circuits.

Pending U.S. patent application Ser. No. 536,303 filed on Sept. 27, 1983 by Charles R. Nestor, Robert G. Plyler and William E. Cross, now U.S. Pat. No. 4,521,065 discloses an electric socket connector for detachably connecting the ends of parallel printed circuit boards. The connector comprises a dielectric connector body which houses and individually retains a plurality of sinuous contact strips. The contact strips are formed of round wire and have resilient clip portions for engaging the respective ends of the printed circuit boards which are plugged into the connector body.

My pending U.S. patent application Ser. No. 643,160 filed Aug. 22, 1984 discloses a header connector which is permanently attached to a flexible printed circuit to detachably mate with a plug-in connector of a wiring harness. The header connector comprises a dielectric connector body and a plurality of round wire pin terminals. The connector body is attached to the flexible printed circuit and the pin terminals are attached to the conductor strips of the flexible printed circuit by crimped splice ferrules.

The object of this invention is to provide an electrical connector specifically for connecting a flexible printed circuit to a printed circuit board.

One feature of the invention is that the electrical connector is adapted for permanent attachment to a flexible printed circuit and detachable connection to a terminal portion of a printed circuit board.

Another feature of the invention is the use of performed contact strips which are inserted into terminal cavities of a dielectric connector body and individually retained in an operative position in an unique manner.

Another feature of the invention is that the contact strips are formed from a length of wire of circular cross section to simplify construction and reduce cost.

Yet another feature of the invention is that the contact strips are spring tempered to provide resilient clips for engaging the printed circuit board and then selectively annealed to provide soft legs for permanent attachment to the flexible printed circuit by crimped splice ferrules.

Yet another feature of the invention is that the connector body of the electrical connector has a socket portion which includes latch arms which assist in plugging the printed circuit board in the socket portion.

Still yet another feature of the invention is that the plugged-in printed circuit board provides connector lock assurance for the latch arms.

Other objects and features of the invention will become apparent to those skilled in the art as the disclosure is made in the following detailed description of a preferred embodiment of the invention as illustrated in the accompanying sheet of drawings in which.

Figure 1:
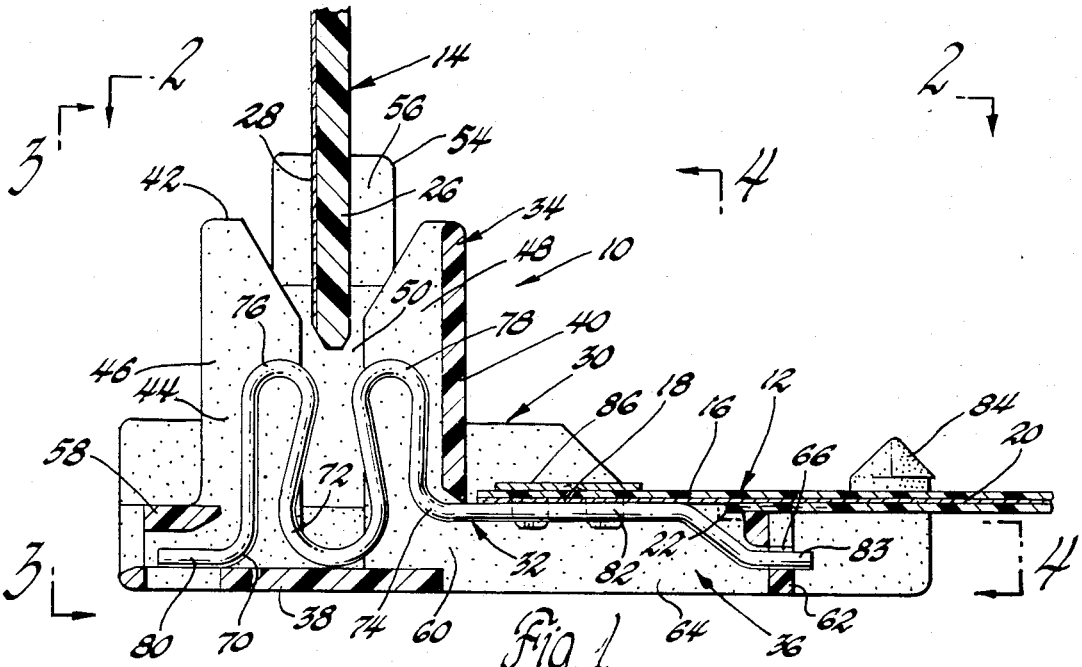
FIG. 1 is a sectioned side view of an electrical connector in accordance with this invention which is permanently attached to a flexible printed circuit and which has a printed circuit board partially inserted for detachable connection.

Referring now to the drawing, FIG. 1 shows an electrical connector 10 for connecting a flexible printed circuit 12 to the terminal portion at the end of a printed circuit board 14. Flexible printed circuits and printed circuit boards are well known in the art differing primarily in the characteristics of the dielectric support member. The flexible printed circuit 12 thus comprises a relatively thin, stiffly flexible sheet or sheets of dielectric material such as Mylar ® which is the trademark of DuPont Corporation for their polyester film and a plurality of thin conductive strips of copper or the like.

The printed circuit board 14 on the other hand comprises a relatively thick and rigid dielectric board made of a phenolic resin, for example, and a plurality of thin conductive strips of copper or the like. The conductive strips are usually encased between two sheets in flexible printed circuits while the conductive strips may be provided on either or both surfaces of the rigid support in the case of printed circuit boards by any of several well known techniques.

In any event, the conductive strips may be arranged in any desired pattern on the support members and any number of electrical or electronic devices (not shown) may be secured to the dielectric supports and electrically connected to the conductive strips to form a desired electrical circuit or circuits. Printed circuits, whether flexible or rigid, customarily have a terminal or end portion where the conductive strips are arranged in a parallel fashion on close centerlines for interconnection with other electrical devices.

Figure 2:
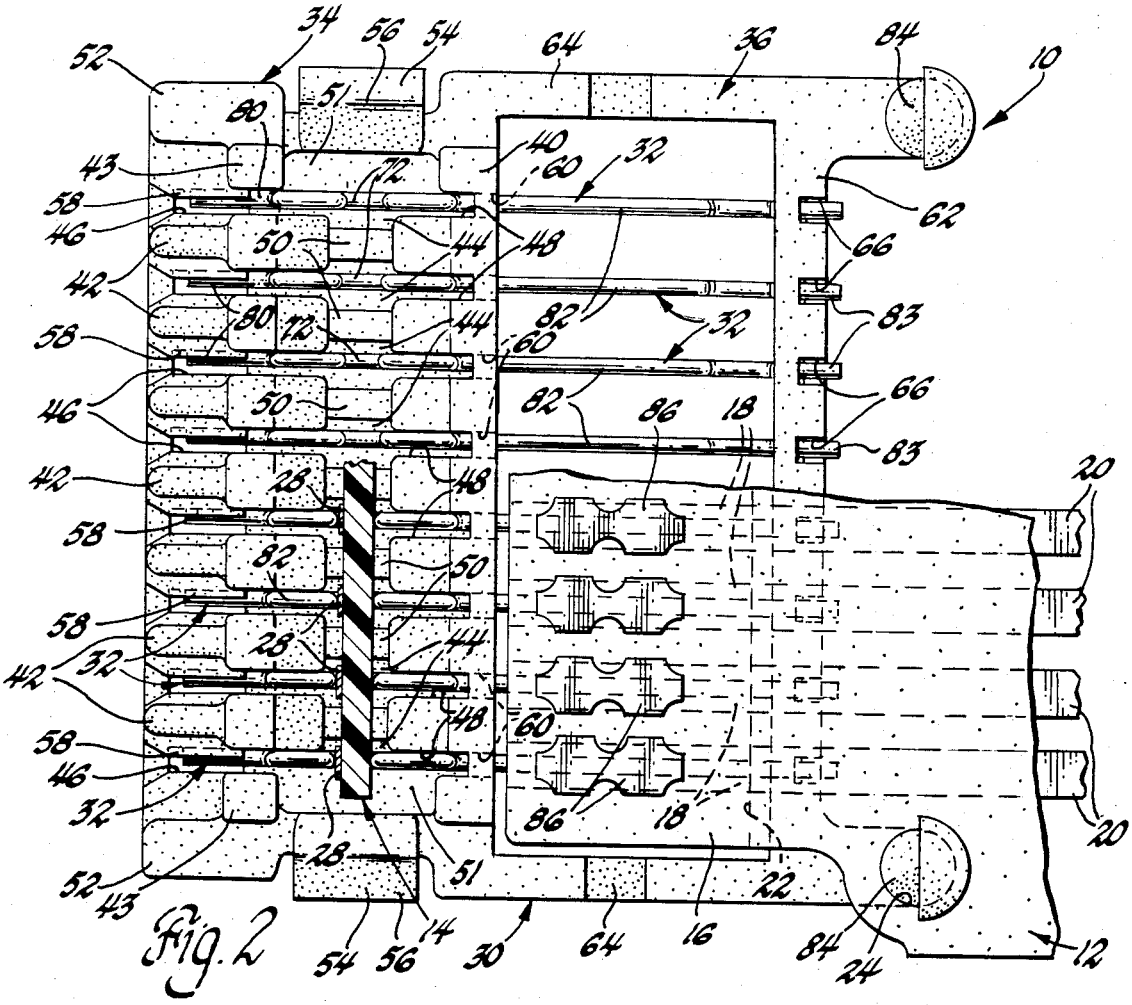
FIG. 2 is a top view of the electrical connector shown in FIG. 1 taken substantially along the line 2—2 of FIG. 1 looking in the direction of the arrows.

Thus, the flexible printed circuit 12 has a terminal portion or end tab 16 where a plurality of parallel end segments 18 of the conductor strips 20 are exposed by removal of a layer of insulation schematically illustrated by the edge line 22 in FIG. 2. The flexible printed circuit 12 also has two locating holes 24 rearwardly of the edge line 22.

The printed circuit board 14 likewise has a terminal portion or end tab 26 where a plurality of the end segments 28 of the conductor strips are arranged in a parallel fashion on close centerlines.

The electrical socket connector 10 for the printed circuits 12 and 14 comprises a dielectric connector body 30 and a plurality of sinuous contact strips 32. The connector body 30, has a socket portion 34 for receiving the end tab 26 of the printed circuit board 14 and a trailing attachment portion 36 for connecting the flexible printed circuit 12.

The socket portion 34 comprises a base 38, an end wall 40 at the trailing end of the base 38, and a plurality of spaced inboard and outboard partition walls 42,43 which are integrally connected to the base 38 and the end wall 40 to define a row of terminal cavities 44. The terminal cavities 44 have interconnected openings 46 and 48 at the leading end and at the top of the socket portion 34 which extend from the base 38 and wrap around to the end wall 40 as best shown in FIG. 1.

The inboard and outboard partition walls 42,43 have aligned slots 50,51 which provide a row of slots which are open at the top of the socket portion 34 for receiving the end tab 26 of the printed circuit board 14. The upper portions of the slots 50 in the inboard partition walls 42 converge from a wide opening at the top of the socket portion 34 to guide the end tab 26 into the narrow lower portions as best shown in FIG. 1. The slots 51 in the two outboard partition walls 43 remain wide for their full depth.

Figure 3:
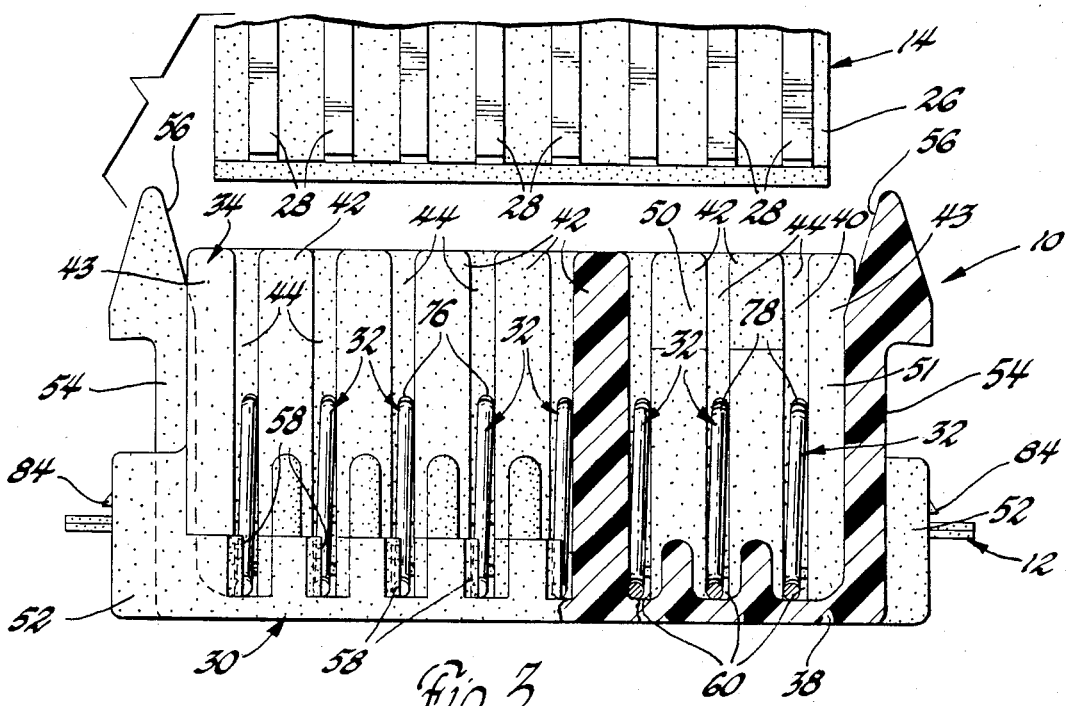
FIG. 3 is an end view of the electrical connector shown in FIG. 1 taken substantially along the line 3—3 of FIG. 1 looking in the direction of the arrows.

The socket portion 34 includes side flanges 52 and latch arms 54 projecting therefrom which are juxtaposed the outboard partition walls 43 to close off the outer sides of the slots 51 as shown in FIGS. 2 and 3. The upper portions of the latch arms 54 have inward surfaces 56 which converge to guide the end tab 26 into a proper lateral position in the socket portion 34 which is determined by the side flanges 52 and latch arms 54.

Each partition wall 42,43 has a lock nib 58 near the base 38 at the leading end of the socket 34 as shown in FIGS. 1, 2 and 3. The lock nibs 58 project into the respective terminal cavities 44 to individually retain the respective contact strips 32 therein.

The end wall 40 has a row of exit apertures 60 for the respective terminal cavities 44 which extend through the bottom portion of the end wall 40 near at the base 38.

The trailing attachment portion 36 of connector body 30 comprises an outrigger 62 which is spaced from the trailing end of the socket portion 34 and connected thereto by a pair of integral extensions 64 of the side flanges 52 of the base 38. The outrigger 62 has a row of apertures 66 extending through it which are aligned with the respective terminal cavities 44 and exit apertures 60.

The electrical socket connector 10 also includes a plurality of sinuous contact strips 32 which may be made conveniently from a length of wire of circular cross section which is bent to the form shown in FIG. 1. More particularly, the sinuous contact strip 32 comprises an L-shaped portion 70 at the leading end, an intermediate U-shaped clip portion 72 and an L-shaped portion 74 at the tail end. The clip portion 72 has a round or curved bottom and straight legs which converge toward each other at the open end of the clip portion where the legs are curved outwardly. The curved ends of the clip portion 72 are connected to the L-shaped end portions 70 and 74 by bights 76 and 78.

The L-shaped portion 70 terminates in a short leg 80 which is beneath the lock nib 58 of the terminal cavity 44 and the L-shaped portion 74 terminates in an elongated leg 82 which extends through the associated exit and outrigger apertures 60,66.

A contact strip 32 is inserted, tail end first, into each of the terminal cavities 44 through the interconnected openings 46 and 48 so that the elongated leg 82 is threaded through the exit aperture 60 and then into the outrigger aperture 66 while the short leg is snapped past the lock nib 58 to retain the contact strip 32 in the operative position shown in FIGS. 1, 2 and 3. In this retained operative position, the U-shaped clip portion 72 is aligned with the row of slots 50 and 51 and the elongated leg 82 extends across the open span between the socket portion 34 and the outrigger 62. The terminus 83 of the elongated leg 82 which extends through the outrigger aperture 66 is offset downwardly so that the elongated leg 82 is at the same height as the outrigger 62.

Figure 4:
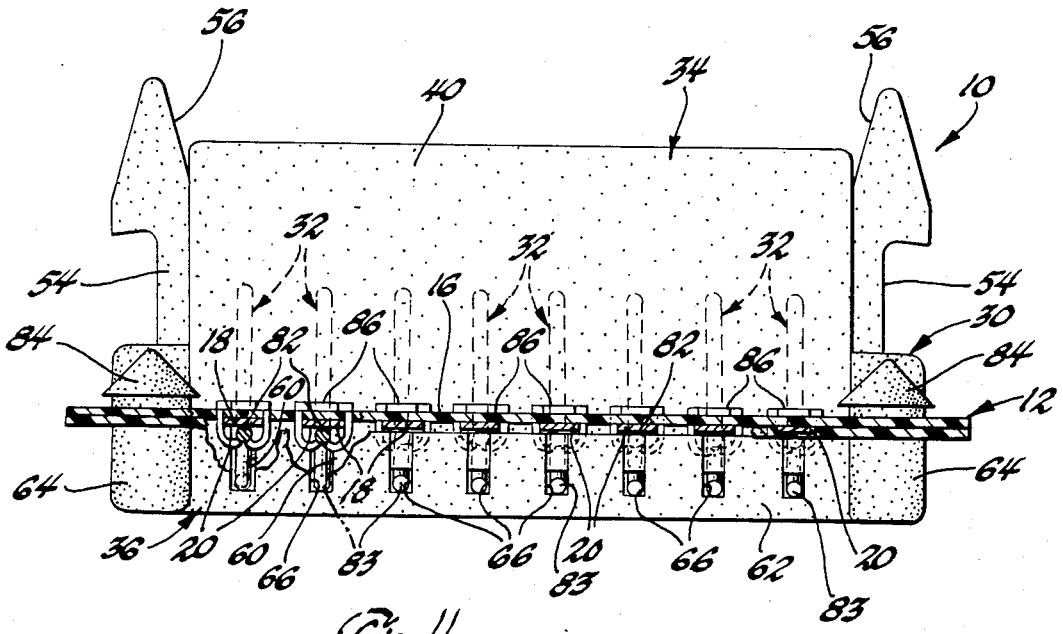
FIG. 4 is an opposite end view of the electrical connector shown in FIG. 1 taken substantially along the line 4—4 of FIG. 1 looking in the direction of the arrows.

When all of the contact strips 32 are retained in an operative position in the connector body 10, the flexible printed circuit 12 is then permanently attached to the connector body 10 by the projections 84 which are inserted through the locating holes 24 of the flexible printed circuit 12 and headed. The end tab 16 of the flexible printed circuit 12 which overlies the open span between the socket portion 34 and the outrigger 62 is then attached to the contact strips 32 by the splice ferrules 86 which are pushed through the insulation and crimped about the elongated legs 82 to bias them against the exposed faces of the conductor strip end segments 18 as shown in FIGS. 1 and 4.

The printed circuit board 14 is then detachably connected simply by plugging the end tab 26 into the row of slots 50,51 which together with the latch arms 54 guides the end tab 26 into the clip portions 72 of the contact strips 32 to establish electrical connections between the respective conductive strips of the flexible printed circuit 12 and the printed circuit board 14.

I wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector for connecting a flexible printed circuit to an end tab of a printed circuit board, comprising:

a dielectric connector body having a socket portion and a trailing attachment portion, said socket portion having a base, an upright end wall at the trailing end of the base and a plurality of spaced partition walls which are integrally connected to the base and the end wall to define a row of terminal cavities which have interconnected openings at the leading end and the top of the socket portion, a row of aligned slots in the respective partition walls which are open at the top of the socket portion for receiving an end tab of a printed circuit board in the row of terminal cavities, a lock nib extending into each terminal cavity near the base and the opening at the leading end, and an exit aperture for each terminal cavity extending through the end wall near the base, said trailing attachment portion having an outrigger spaced from the trailing end of the base of the socket portion and connected thereto solely by a pair of integral side extensions to provide an open span between the socket portion and the outrigger, and a row of apertures extending through the outrigger aligned with the respective exit apertures of the terminal cavities, and a plurality of contact strips associated with the respective terminal cavities, exit apertures, and outrigger apertures, each said contact strip having a locking portion at one end which cooperates with the lock nib of a terminal cavity to retain the contact strip in an operative position, an intermediate resilient clip portion which is disposed in the terminal cavity for engaging the end tab of the circuit board when it is inserted into the socket portion, and an elongated portion at the other end which extends through the exit aperture of the terminal cavity and the outrigger aperture associated with the terminal cavity so that the elongated portion extends across the open span between the socket portion and the outrigger for connection to a flexible printed circuit.

2. The electrical connector as defined in claim 1 wherein the connector body has a pair of latch arms which are disposed adjacent the slots in the respective outboard partition walls of the socket portion and which have inward surfaces at their upward ends which converge for guiding an end tab into the socket portion.

3. The electrical connector as defined in claim 1 wherein the elongated portion of each contact strip has an offset terminus which extends through the outrigger aperture so that the elongated portion is at the same height as the outrigger.

4. The electrical connector as defined in claim 1, 2 or 3 wherein each contact strip is formed of a length of wire of circular cross-section, with the locking portion being L-shaped, the intermediate resilient clip portion being spring tempered and U-shaped, and the elongated portion of the other end being annealed and L-shaped.

5. The electrical connector as defined in claim 1, 2 or 3 wherein each contact strip is formed of a length of wire of circular cross-section bent to form an L-shaped portion at one end which provides the locking portion, an intermediate resilient U-shaped clip portion which provides the intermediate resilient clip portion for engaging said end tab, and an L-shaped portion at the opposite end which provides the elongated portion at the other end for connection to a flexible printed circuit, the U-shaped clip portion comprising a round bottom and converging legs which have curved ends connected to the respective L-shaped portions by bights and the contact strip being spring tempered and then selectively annealed to soften the elongated leg for connection to the flexible printed circuit as by a crimped splice ferrule or the like.

6. An electrical connector for connecting a flexible printed circuit to an end tab of a printed circuit board, comprising:

a dielectric connector body having a socket portion and a trailing attachment portion, said socket portion having a base, an upright end wall at the trailing end of the base and a plurality of spaced partition walls which are integrally connected to the base and the end wall to define a row of terminal cavities which have interconnected openings at the leading end and the top of the socket portion, a row of aligned slots in the respective partition walls which are open at the top of the socket portion for receiving an end tab of a printed circuit board in the row of terminal cavities, a pair of latch arms adjacent the slots in the respective outboard partition walls, said latch arms having inward surfaces at their upper ends which converge for guiding an end tab into the socket portion, a lock nib extending into each terminal cavity near the base and the opening at the leading end, and an exit aperture for each terminal cavity extending through the end wall near the base, said trailing attachment portion having an outrigger spaced from the trailing end of the base of the socket portion and connected thereto by a pair of integral side extensions to provide an open span between the socket portion and the outrigger, and a row of apertures extending through the outrigger aligned with the respective exit apertures of the terminal cavities, and a plurality of contact strips associated with the respective terminal cavities, exit apertures, and outrigger apertures, each said contact strip being formed of a length of wire of circular cross section and having an L-shaped locking portion at one end which cooperates with the lock nib of a terminal cavity to retain the contact strip in an operative position, an intermediate resilient spring tempered, U-shaped clip portion which is disposed in the terminal cavity for engaging the end tab of the circuit board when it is inserted in the socket portion, and an L-shaped portion at the other end which includes an elongated annealed leg which extends through the exit aperture of the terminal cavity and the outrigger aperture associated with the terminal cavity so that the elongated annealed leg extends across the open span between the socket portion and the outrigger for connection to a flexible printed circuit.

7. An electrical connector for connecting a flexible printed circuit to an end tab of a printed circuit board, comprising:

a dielectric connector body having a socket portion and a trailing attachment portion, said socket portion having a base, an end wall at the trailing end of the base and a plurality of spaced partition walls which are integrally connected to the base and the end wall to define a row of terminal cavities, and which have a row of aligned slots for receiving an end tab of a printed circuit board in the row of terminal cavities, each terminal cavity having a lock nib and an exit aperture extending through the end wall, said trailing attachment portion having an outrigger spaced from the trailing end of the base of the socket portion and connected thereto solely by a pair of integral side extensions to provide an open span between the socket portion and the outrigger, and a row of apertures extending through the outrigger aligned with the respective exit apertures of the terminal cavities, and a plurality of contact strips associated with the respective terminal cavities, exit apertures, and outrigger apertures, each said contact strip having a locking portion at one end which cooperates with the lock nib of a terminal cavity to retain the contact strip in an operative position, an intermediate resilient clip portion which is disposed in the terminal cavity for engaging the end tab of the circuit board when it is inserted into the socket portion, and an elongated portion at the other end which extends through the exit aperture of the terminal cavity and the outrigger aperture associated with the terminal cavity so that the elongated portion extends across the open span between the socket portion and the outrigger for connection to a flexible printed circuit, said elongated portion having a terminus disposed in the outrigger aperture which is offset downwardly so that the elongated leg extends across the open span at the height of the outrigger.

8. The electrical connector as defined in claim 7 wherein a pair of latch arms are disposed adjacent the slots in the respective outboard partition walls and have inward surfaces at their upward ends which converge for guiding an end tab into the socket portion.

9. The electrical connector as defined in claim 7 or 8 wherein each contact strip is formed of a length of wire of circular cross-section, with the locking portion being L-shaped, the intermediate resilient clip portion being spring tempered and U-shaped, and the elongated portion at the other end being annealed and L-shaped.

10. The electrical connector as defined in claim 7 or 8 wherein each contact strip is formed of a length of wire of circular cross-section bent to form an L-shaped portion at one end which provides the locking portion, an intermediate resilient U-shaped clip portion which provides the intermediate resilient clip portion for engaging an end tab, and an L-shaped portion at the opposite end which provides the elongated portion at the other end for connection to a flexible printed circuit, the U-shaped clip portion comprising a round bottom and converging legs which have curved ends connected to the respective L-shaped portions by bights and the contact strip being spring tempered and then selectively annealed to soften the elongated leg for connection to the flexible printed circuit as by a crimped splice ferrule or the like.

* * * * *